United States Patent [19]

Novak

[11] 4,150,512

[45] Apr. 24, 1979

[54] APPARATUS FOR CLEANING MOVING ABRASIVE MEMBERS

[76] Inventor: Walter M. Novak, P.O. Box 23279, Portland, Oreg. 97223

[21] Appl. No.: 828,266

[22] Filed: Aug. 29, 1977

[51] Int. Cl.[2] ..... B24B 55/00

[52] U.S. Cl. ..... 51/262 A; 134/144; 134/181; 239/563

[58] Field of Search ..... 51/262 A, 293.5 D, 295.5 R, 51/263, 264, 102; 134/144, 153, 161, 180, 181, 198; 239/102, 225, 451, 562, 563, 567

[56] References Cited

U.S. PATENT DOCUMENTS

| | | | |
|---|---|---|---|
| 1,413,060 | 4/1922 | Roberts | 51/262 A |
| 1,712,751 | 5/1929 | Cunningham | 51/293 |
| 2,201,196 | 5/1940 | Williamson | 51/295 |
| 2,558,376 | 6/1951 | Opp et al. | 239/563 |
| 2,568,096 | 9/1951 | Stewart | 51/102 |
| 2,695,002 | 11/1954 | Miller | 239/225 |
| 3,233,997 | 2/1966 | Moreau | 239/563 |
| 3,812,622 | 5/1974 | Parsons | 51/5 D |

OTHER PUBLICATIONS

Sheffield All New Universal Super-Jet Grinding Wheel Cleaner, catalog No. SJWC-965, p. 5, Bendix Automation and Measurement Div.

*Primary Examiner*—Harold D. Whitehead
*Assistant Examiner*—Roscoe V. Parker
*Attorney, Agent, or Firm*—Eugene M. Eckelman

[57] ABSTRACT

An elongated cylindrical housing is arranged to be mounted adjacent to and parallel with the surface of a moving abrasive member and has a row of ports establishing communication between the interior of the housing and its exterior. An elongated cylindrical core member is rotatably supported in the housing and has a spiral groove in its surface of a selected width and pitch such that a small number of ports are exposed to the groove at a time to form a narrow jet. Fluid under pressure is supplied to the groove and upon rotation of the core member the jet of fluid travels across the surface of the moving abrasive member to clean it. A cam is provided in the present apparatus to reciprocate the housing in its longitudinal dimension through a distance approximately equal to the spacing of the ports so that the surface of the abrasive member between the ports is also cleaned.

5 Claims, 7 Drawing Figures

APPARATUS FOR CLEANING MOVING ABRASIVE MEMBERS

BACKGROUND OF THE INVENTION

This invention relates to new and useful improvements in apparatus for cleaning the surface of a moving abrasive member such as a sanding belt Sanding belts are in common use for finishing the surface of plywood or other sheet products in the manufacture thereof. These belts are rather wide in order to sand a sheet as the latter is passed thereunder. A problem exists in this art in that the sanding belt becomes clogged and rapidly becomes less effective or entirely ineffective. In an attempt to obviate this problem, cleaning apparatuses have been employed to blow or wash the dust from the sanding belt. Due to the width of the belt, a large capacity blowing and cleaning system must be provided because of the requirements of air or liquid that are being ejected. Thus, large capacity compressors or holding systems must be provided and of course such is a definite disadvantage. Some systems also employ a travelling nozzle for air and/or solvent, such as shown in U.S. Pat. No. 3,812,622. While such a system requires a smaller capacity compressor and holding system, it has the disadvantage that the mechanism to provide the reciprocating movement is complicated and also easily disabled by dust or liquid. Such mechanism also can easily be damaged by a broken belt.

SUMMARY OF THE INVENTION

According to the present invention and forming a primary objective thereof, an apparatus is provided for cleaning the surface of a moving abrasive member which is efficient in use and at the same time is relatively simplified in construction, which requires a minimum capacity compressor system, and which is relatively incapable of damage by dust and broken belts.

In carrying out the above objectives, an elongated hollow cylindrical housing has a row of ports along its longitudinal length and is arranged to be mounted substantially parallel with the surface of a moving abrasive member with the ports directed at the abrasive member. An elongated core member is rotatably supported within the housing and has a spiral groove which meters out pressurized fluid in a jet through the ports which travels across the surface of the abrasive member as the core member rotates. The jet of fluid is the width of only a few of the ports so as to require a minimum of compressor capacity and little or no fluid holding system. Means are provided to reciprocate the housing in its longitudinal dimension through a distance approximately equal to the spacing of the ports so as to clean the abrasive member in the area between the ports.

The invention will be better understood and additional objects and advantages will become apparent from the following description taken in connection with the accompanying drawings.

DETAILED DESCRIPTION OF A PREFERRED EMBODIMENT

Figure 1:
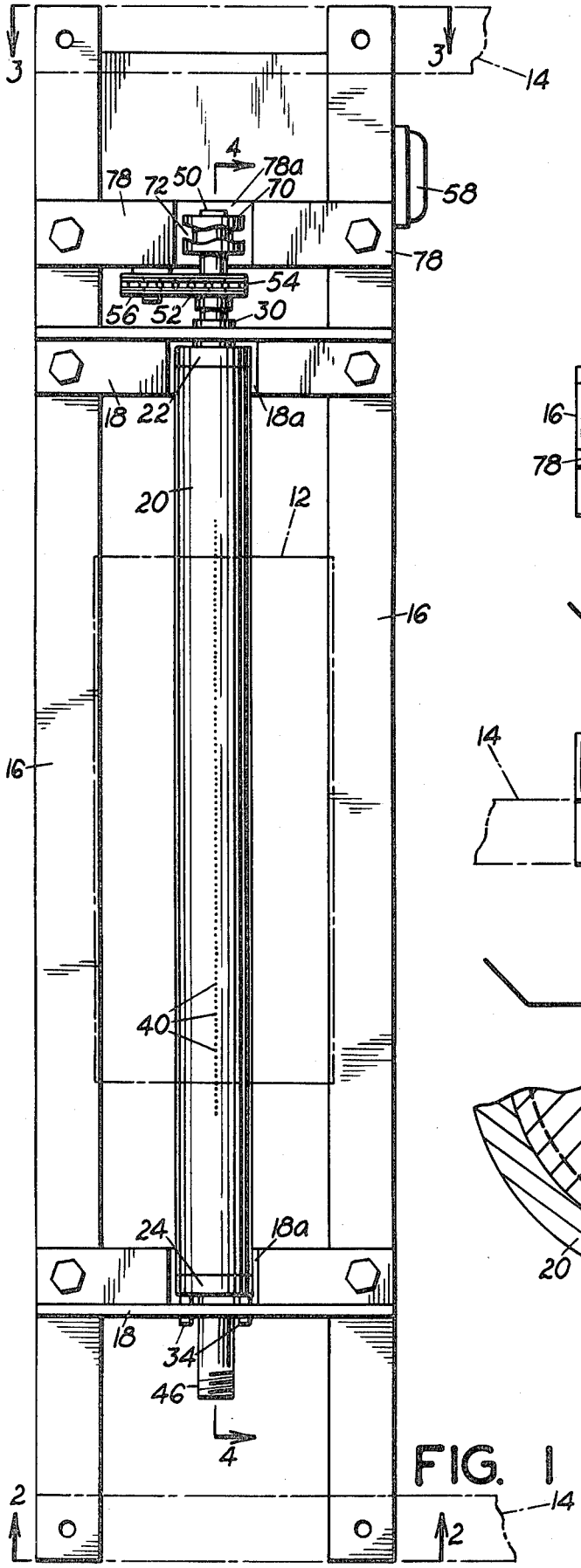
FIG. 1 is a plan view looking into the outlet portion of apparatus for cleaning the surface of a moving abrasive member embodying features of the present invention, this view being taken on the line 1—1 of FIG. 6.
Figure 3:
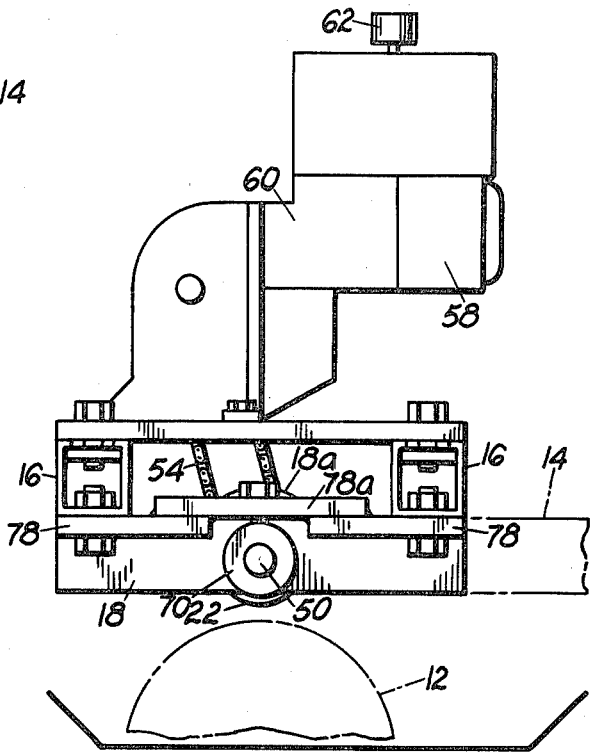
FIG. 3 is also a vertical side elevational view but taken from the opposite side from FIG. 2, this view being taken on the line 3—3 of FIG. 1.
Figure 2:
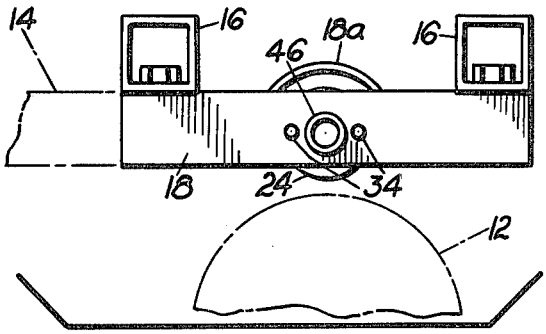
FIG. 2 is a vertical side elevational view of the apparatus taken on the line 2—2 of FIG. 1.
Figure 6:
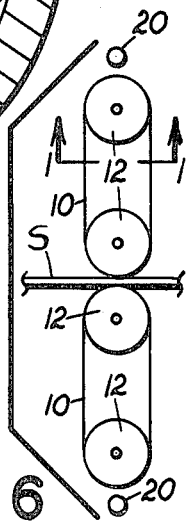
FIG. 6 is a diagrammatic view of a sanding assembly for traveling sheet products and including the present cleaning apparatus associated therewith.

With particular reference first to FIG. 6, the numeral 10 designates upright sanding belts which move at high speed over upper and lower rollers 12, also seen in FIGS. 1, 2 and 3. The sanding belts are engageable with the surfaces of sheets S to be sanded which are moved by a conveyor and feed rolls, not shown.

The present apparatus is arranged to be supported adjacent to the belts and across the latter by suitable frame members 14 shown in broken lines and two or more cross frame members 16, it being preferred that the present apparatus be located at upper and lower areas of the upper and lower rollers 12, respectively, or in adjacent areas so as to clean the belt at a point where it extends over a rounded surface of the end rollers whereby the areas between abrasive particles will be open. The drawings illustrate in detail the apparatus associated with the top roller 12, the apparatus associated with the lower roller 12 being the same except for mounting structure.

With reference to FIGS. 2, 3, 4A and 4B, a pair of angle frame members 18 are secured in spaced relation between cross frame members 16. The two frame members 18 support an elongated tubular cylindrical housing 20 by means of opposite end closures 22 and 24 having threaded connections 26 with the housing. O-ring seals 28 are included in these connections. Portions **18*a* of frame members 18 are curved outwardly to receive the housing 20** with clearance.

End closure 22 has an end extension 30 slidably extending through an aperture 32 in a frame member 18. The end closure 24 has a pair of supporting projections 34 which project slidably through apertures 36 in the opposite frame member 18. The apertures 32 and 36 provide suitable support for the housing 20 but allow a slidable movement therein for a purpose to be described, suitable spacing 38 being provided between the inner surface ends of the end closures and the frame members 18 to allow for such slidable movement.

The wall of housing 20 has a row of closely spaced ports 40 through which a pressured fluid, such as air, liquid, or a combination of the two, is to be ejected. This row of holes is of a length to extend at least the width of the sander belt 10.

Figure 4A:
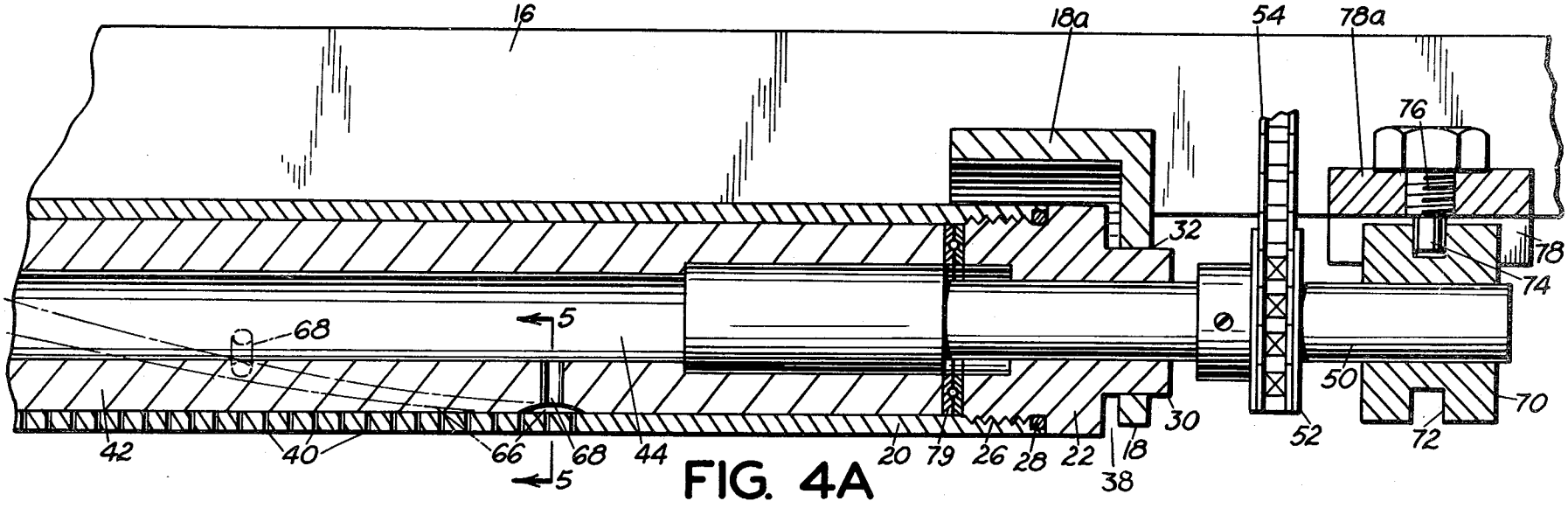
FIGS. 4A and 4B comprise enlarged sectional views in composite form taken on the line 4—4 of FIG. 1.
Figure 4B:
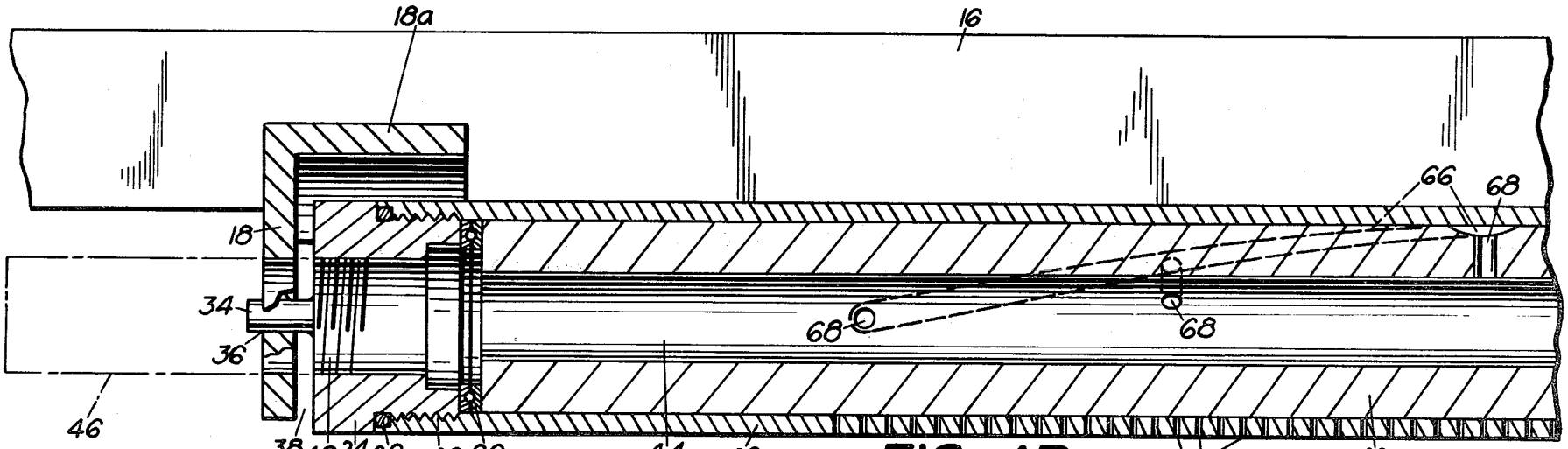

Rotatably supported within the housing 20 in surface sealing engagement is a cylindrical core member 42 having an axial bore or passageway 44 one end of which communicates with a source of compressed fluid through the medium of suitable conduit means 46 shown in full lines in FIG. 1 and in broken lines in FIG. 4B. This conduit is connected into a tapped bore 48 in the thrust bearing assembly 24.

The opposite end of core member 42 from the fluid inlet end has an integral shaft extension 50 which seals this end of the bore 44 and which passes rotatably through the end closure 22. This shaft extension projects beyond the end of the end closure 22 and has a sprocket wheel 52 secured thereon driven by a sprocket chain 54 from a sprocket wheel 56 secured on the output shaft of suitable drive mechanism such as an electric motor 58, FIG. 3. Motor 58 has suitable gear reduction means 60 as well as speed control means 62. Upon operation of motor 58, core member 42 is rotated within the housing 20, the housing being held against rotation by projections 34.

Figure 5:
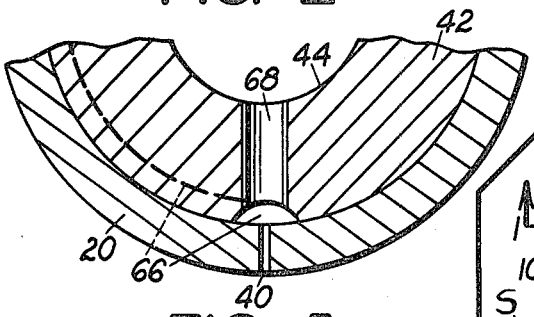
FIG. 5 is an enlarged fragmentary sectional view taken on the line 5—5 of FIG. 4A.

The outer surface of the core member 42 has a longitudinal spiral groove 66, also seen in FIG. 5, which is of a length approximately the length of the row of ports 40. Several ports 68 establish communication between the bore 44 and at spaced points along the spiral groove 66 to provide an adequate and even distribution of fluid pressure in the groove 66. Upon rotation of the core member 42 by the drive mechanism 58, the spiral groove 66 serves as a valve to cause a narrow jet of fluid to be ejected through the ports 40 in traveling movement across the housing to clean the sanding belt. The width of the jet depends upon the width and pitch of the groove 66, and of course the frequency of movement of the jet across the housing will depend upon the pitch of such groove and the speed of rotation of the core member 42. One or more of the grooves may be provided if desired.

Although the ports 40 are spaced relatively close together, the fluid jets therefrom may leave an unclean area on the belt between such ports, and to provide a complete cleaning path, means are provided to reciprocate the housing 20 as the core member 42 is being rotated. Such means comprises a cam 70, FIGS. 1, 3 and 4A, secured to the shaft extension 50 for rotation therewith and having a cam groove 72 in its peripheral surface concentric with the axis. A cam follower 74 projects into the groove 72 and has a stationary screw connection 76 on a frame member 78 secured to frame members 16. Frame member 78 has an offset portion 78*a* for clearance with the cam. The ends of core member 42 abut against thrust bearings 79 and 80 whereby upon rotation of the core member, the cam 70 will cause the entire housing assembly 20 and core member to reciprocate. The reciprocating movement caused by the cam will be at least equal to the spacing between ports 40 so that the area on the sanding belt will be fully engaged by the fluid jet. Clearance areas 38 between the end closures 22 and 24 and their respective frame members 18 allow for reciprocation of the housing.

According to the present invention, apparatus for cleaning sanding belts and the like is provided which accomplishes efficient removal of dust and other foreign particles and which at the same time is relatively simple in construction and inexpensive to manufacture. Furthermore, the apparatus is substantially maintenance free in operation and will not be damaged by a broken belt.

It is to be understood that the form of my invention herein shown and described is to be taken as a preferred example of the same and that various changes in the shape, size and arrangement of parts may be resorted to without departing from the spirit of my invention, or the scope of the subjoined claims. Although the present invention is illustrated for use with sanding belts, it can as well be used with any type of moving member, whether or not an abrasive member.

Having thus described my invention, I claim:

1. In combination, (a) a sanding belt operating over end rollers and having a widened abrasive surface to be cleaned, (b) an elongated hollow cylindrical housing arranged to be mounted adjacent to and substantially parallel with said abrasive surface of said sanding belt, (c) said housing having a plurality of radial ports spaced longitudinally therein establishing communication between the interior and exterior of said housing, (d) an elongated cylindrical core member rotatably supported within said housing in interior sealing surface engagement with said housing, (e) a spiral groove in the surface of said core member of a selected width and pitch such that only a small number of ports are exposed to said groove at a time, (f) fluid conducting means supplying pressured fluid to said groove to provide an outlet jet of fluid from said housing the width of the ports which are in communication with said spiral groove, (g) and power means rotating said core member in said housing to provide repeating ones of said jets of fluid to travel across said housing upon rotation of said core member for cleaning the abrasive surface of said sanding belt.

2. The combination according to claim 1 wherein said means for rotating said core member is adjustable in speed to vary the speed of rotation of said core member and thus the frequency of movement of said jets across said housing.

3. In combination, (a) a moving member having a widened surface to be cleaned, (b) an elongated hollow cylindrical housing arranged to be mounted adjacent to and substantially parallel with said surface, (c) a support frame supporting said housing for axial movement, (d) said housing having a plurality of radial ports spaced longitudinally therein establishing communication between the interior and exterior of said housing, (e) an elongated cylindrical core member rotatably supported within said housing in interior sealing surface engagement with said housing, (f) a spiral groove in the surface of said core member of a selected width and pitch such that only a small number of ports are exposed to said groove at a time, (g) fluid conducting means supplying pressured fluid to said groove to provide an outlet jet of fluid from said housing the width of the ports which are in communication with said spiral groove, (h) power means rotating said core member in said housing to provide repeating ones of said jets of fluid to travel across said housing upon rotation of said core member for cleaning the surface of said moving member, (i) and means reciprocating said housing in its longitudinal dimension through a distance sufficient to clean the moving member in the area between said ports.

4. The combination according to claim 3 wherein said means for reciprocating said housing axially comprises cam means providing said axial movement of said housing from rotative movement of said core member.

5. The combination according to claim 3 wherein said means for reciprocating said housing axially comprises cam means providing said axial movement of said housing from rotative movement of said core member, and thrust means in said housing providing said reciprocating connection between said housing and said core member.

* * * * *